United States Patent [19]

Zizka et al.

[11] 4,124,033

[45] Nov. 7, 1978

[54] CIGARETTE FILTER

[75] Inventors: Jaroslav Žizka, Prague; Karel Janoušek, Roztoky; Miroslav Papánek, Kutna Hora, all of Czechoslovakia

[73] Assignee: Vyzkumny Ustav Chemickych Zarizeni, Brno, Czechoslovakia

[21] Appl. No.: 491,452

[22] Filed: Jul. 24, 1974

Related U.S. Application Data

[63] Continuation-in-part of Ser. No. 308,951, Nov. 24, 1972, abandoned.

[30] Foreign Application Priority Data

Nov. 25, 1971 [CS] Czechoslovakia ..... 8241/71

[51] Int. Cl.[2] ..... A24B 15/027; A24D 1/04

[52] U.S. Cl. ..... 131/10.9; 131/266

[58] Field of Search ..... 131/9, 10 R, 10.5, 10.7, 131/207, 265, 264, 266

[56] References Cited

U.S. PATENT DOCUMENTS

| | | | |
|---|---|---|---|
| 2,801,638 | /1957 | Schurr et al. | 131/266 |
| 3,658,069 | 4/1972 | Wise | 131/265 |

FOREIGN PATENT DOCUMENTS

| | | | |
|---|---|---|---|
| 205,940 | 1957 | Australia | 131/264 |
| 13,747 of | 1851 | United Kingdom | 131/207 |
| 1,092,070 | 1967 | United Kingdom | 131/267 |

OTHER PUBLICATIONS

"Industrial Chemistry" by Riegel edited by Kent (p. 530), Reinhold Publishing Co., N. Y., 1962.

*Primary Examiner*—Robert W. Michell
*Assistant Examiner*—V. Millin

[57] ABSTRACT

A cigarette filter made of cellulose material in which has been dispersed particles of finely comminuted bark of coniferous wood species.

6 Claims, No Drawings

CIGARETTE FILTER

RELATED APPLICATION

This is a continuation in part of co-pending application Ser. No. 308,951 now abandoned filed Nov. 24, 1972 to which reference can and is made herein for all its disclosure, as if more fully set forth in the present application.

BACKGROUND OF THE INVENTION

The present invention relates to cigarette filters and more particularly to an improved cigarette filter for retaining detrimental substances contained in the cigarette smoke.

Filters for retaining detrimental substances, such as harsh tars, nicotines, etc. normally contained in the cigarette smoke are known and have been widely used. Filters made from paper or fibrous materials particularly such as for instance cellulose acetate, viscose or the like often have various admixtures which function as adsorptive or adsorptive agents added thereto, such as for example, silica gel and activated carbon.

However, most of the aforementioned filters possess only limited power to retain certain tarry substances contained in the cigarette smoke. They are also poorly selective with respect to nicotine and oxidation products. Moreover, some of the known filters of this type unfavorably influence the taste of the cigarette tobacco.

There exists therefore a need for cigarette filter which eliminates or at least mitigates the disadvantage or drawbacks of the filters mentioned above. The present invention has as its object the provision of a cigarette filter which fulfills such a need.

BRIEF STATEMENT OF INVENTION

In accordance with the present invention there is provided a cigarette filter comprising a conventional paper pulp or fibrous material to which pulp there is added finely comminuted, but not refined bark particles of coniferous wood species preferably pine bark in an amount of 5 to 40% by weight, based on the total weight of the paper or fibrous material.

DESCRIPTION OF THE PREFERRED EMBODIMENTS

Although as little as about 5% to as much as 40% by weight of the bark is employed, as mentioned above, it is preferred that 12.5% by weight be employed in a filter according to the invention the bark being preferably pine bark.

Moreover, the paper pulp or fibrous material employed as the base carrier in forming the filter paper in accordance with the present invention should preferably be cellulose, comprising primarily 50% by weight of a fibre having a thickness of about 5–7$\mu$ such as Swedish cellulose of the alpha A-17 type or 50% by weight of Swedish cellulose Cb3 type. In any event the cellulose pulp is conventional physically and chemically digested and formed in the well known manner into a fibrous pulp.

In making a cigarette filter in accordance with this invention, the comminuted bark is preferably ground to a desired size particle but is not chemically or physically refined into a pulp. After conventional washing and drying the size of the particles employed should be 40$\mu$ or less in diameter, although, generally bark of between 1$\mu$ and 100 can be used. Below 1$\mu$, the retaining capacity of the filter with respect to nicotine becomes undesirably high. When particles of about 100$\mu$ in diameter are used, the retaining efficiency of the filter decreases to a degree which can be easily sensed as a result the quality of the filter paper decreases. Besides, there is a danger that after some interval of storage, spontaneous drying of cigarettes occurs permitting larger particles to become loose and fall out from the paper, or entrained together with the smoke, into the smoker's lungs. This is also true when the smoker mechanically manipulates the cigarettes and causes losing of coarse particles.

The bark particles are simply added to the paper pulp or fibrous which is manufactured by conventional methods with known pulping apparatus such as a pulping engine or Hollander machine.

After preparation of the pulp, the bark is added, and the admixture is homogenized. The homogenized mixture is discharged from the mixing apparatus and processed on conventional paper making machines. It is further worked so that it becomes set-wrinkled or wet-crinkled to form a crepe paper which may then be cut into narrow strips. The narrow strips are coiled or rolled in conventional manner commonly referred to as a filter rod or stick. The rods are then cut into suitable lengths for use as cigarette filter plugs. During the manufacturing process, the comminuted bark does not undergo change in either its chemical or physical properties; care being taken during the pulping, mixing, forming and crinkling process to insure this.

It has been surprisingly found that the capability of a filter according to the present invention, for retaining poly-cyclic tarry hydrocarbons, either carcinogenic or non-carcinogenic, is higher than that encountered with well known filters and exceeds regulating standards currently being required by governmental health bodies.

This unexpected capability is attributable to the addition to conventional cellulose pulp, of dry discrete and unchanged particles of conifirous wood bark which contains a cellulose lattice impregnated with a natural resinous substance, called suberine. The suberine which is a complex organic molecule is congenial and attractive to the poly-cyclic tarry hydrocarbons and thus exerts a favorable effect upon the selective separating power of the filter for this material.

Further, the filter according to the present invention is characterized by a high permeability to nicotine and its oxidation products so that it does not reduce the taste and pleasure enjoyed by the tobacco smoker.

Another advantage of the filter according to the present invention resides in the fact that the selective material has a negligible moisture regain so that it is not prone to moisture oversaturation in the mouth of the smoker.

Since the bark of conifirous wood is easily available as waste material, it is much cheaper than the other well known admixtures to cigarette filters, such as silica gel or activated carbon, so that the use thereof for this purpose is advantageous from an economical viewpoint.

In order to illustrate the present invention more fully, the following illustrative example is given. It is to be understood that the example is merely illustrative and not limitative of the invention. In the example all parts and percents are by weight unless otherwise stated.

THE EXAMPLES

The following are several examples of the use of pine bark or coniferous bark as filling material for filter plug otherwise conventionally made from paper. In each of the examples the pine bark was washed and dried and thereafter ground in a mill (of any suitable form) and assorted according to the size of its particles. For the manufacture of cigarette filter plugs, bark particles of the diameter of 40μ or smaller were separated and used. The ground pine bark was supplied to the pulp engine in which the paper or fibrous cellulose pulp was previously made. The pulp was chemically and physically formed of aqueous mixture of fibers, bleach adhesives and other additives. The bark particles were admixed with the paper pulp so as to form a homogeneous mixture without pulping of the bark particles themselves. The homogeneous mixture was then fed onto the conventional paper making machine and a sheet of filter paper was formed in which particles of the bark were uniformly dispersed throughout. The resulting filter paper was thereafter worked so as to be creped by either the wet crinkling or wet wrinkling processes. The creped paper was cut into narrow strips which were then coiled or rolled to form tubular rods or sticks. The rods were then cut into conventional filter plugs and tested for their adsorption capabilities.

The examples are:

I.

Cigarette filter containing:

5% weight of pine bark in the paper pulp shows: an apparently increased adsorption capability to dry distillation products; taste unchanged;

II.

10% by weight of pine bark in the paper pulp shows: adsorption capability much more increased; the flavor of the cigarette sensibly refined, pungency and smartness reduced;

III.

12.5% by weight of pine bark in the paper pulp shows: adsorption capability very high, flavor and taste of the cigarette apparently refined; no pungency and smartness can be felt in the cigarette smoke even when secondary class tobacco has been used. this composition has proved to be the optimum one.

IV.

20% by weight of pine bark in the paper pulp shows: the adsorption power very high, but the cigarette smoke losing its characteristic flavor and taste; cigarettes provided with this kind of filter show too low physiological effect. Suitable for smokers preferring weak cigarettes only;

V.

40% by weight of pine bark in the paper pulp shows: Cigarettes provided with this kind of filter does not represent a cigarette any more; all the effective components are entirely adsorbed (retained), the smoker inhales pure carbon dioxide only.

COMPARATIVE EXAMPLES

The bark of other trees such as deciduous trees such as birch, spruce or oak were used to form filter material similar to that made with pine bark and were tested and compared therewith. In using the birch, spruce or oak bark, the bark was washed, dried and ground and thereafter admixed with the paper pulp in exactly the same manner as in the aforementioned examples.

While all of the bark were indicated to have good adsorption power against the vapors of organic compounds such as, for instance, benzopyrene and similar polycyclic aromatic compounds, or acetaldehyde, acrolein and similar aldehydes, and separation capability for particles of liquid aerosols of similar compounds (as for instance the oil or tar vapors) coniferous bark, particularly the pine bark of the examples of the present invention surpassed all of them with respect to adsorption and separation efficiency and particularly as to its selectivity of the various vapors. The adsorption power of the pine bark reached its top value just within the area of the tarry hydrocarbons, that is within the area of aerosols of dry distillation products. The comparative tests were also made on the so-called "Cambridge filter" which has recently been given very wide publicity. The Cambridge filter is a part of an "Automatic Smoker," i.e. of a device that is adapted to perform reproducible smoking tests. The Automatic Smoker provides for uniformity in smoking, i.e. the draft intensity, etc. In the Cambridge filter as a part of the Automatic Smoker the compounds are retained that have not been retained by means of the tested cigarette filter and that would penetrate otherwise into the smoker's mouth. The samples achieved on the Cambridge filter are then evaluated by means of the chromatographic analysis. The Cambridge filter however, did not demonstrate the ability at adsorption capability comparable to that of a paper filter filled with comminuted pine bark according to the present invention.

The comparative results of the examples are set forth as follows.

The comparative tests determined the soaking ability of various kinds of bark in crude oil (petroleum). In the results the % represents the percentage of bark by weight necessary to retain 100% by weight of the crude oil.

| Bark | Adsorption capacity (soaking ability) with respect to crude oil |
|---|---|
| pine | 50% |
| spruce | 80% |
| birch | 125% |
| oak | 150% |
| beech | 150% |

From what has been presented above it is clear that one part of pine bark is able to retain 2 parts of crude oil. The difference between the adsorption capacity of pine bark and those of spruce bark or bark of other coniferous or deciduous trees is caused by the fact that bark of those latter trees does not represent a withered netting rich in aromatic compounds, resins and terpenes (and perhaps also tannin as an effective component) like the pine bark does.

Further, there is still another important factor resulting from the pine bark consistency: they are not only surface forces but also capillary forces that take part on the adsorption capacity of the pine bark. This is a special feature of the pine bark. In case that silica gel or activated carbon are used as filling material for the cigarette filters, surface forces take part on the adsorption effect only. And it is commonly known that in an adsorption process, the capillary forces taking part therein, is much stronger and effective than other materials where the surface forces only take part.

Filter containing silica gel or activated carbon operates in a way like a chromatographic column. That is after the capacity of the column becomes fully occupied the column not only stops retaining the compounds to be separated but it even loses amounts of the compounds that have been previously retained and lets the compounds through it in higher concentration than before.

Besides bark, particularly pine bark, has proved to be able to retain bacteria and mold, as well.

It has been found from the above that pine bark provides an improved additive for cellulose filter papers having unexpected and increased adsorptive and selective capabilities. The presence of terpenes in the pine bark presents no difficulty whatsoever to the smoker since the cigarette filter is operated under relatively low temperatures so that there is relatively little danger of the terpene compounds being released and being picked up by the smoke. The results of chromotography analysis of the tabacco smoke of the cigarettes has found little or no terpene released in the cigarette smoke. This has been confirmed by a certificate from the Czechoslovakian State Committee for Inspection of Quality of Food Industry Products. It is furthermore noted that terpene compounds do exist in tobacco itself and this presents no problem with regard to the smoke.

It is clear from the foregoing that the percentage of the finely comminuted bark added to the celluslose pulp by weight can vary over a significant range. It is important however, that the coniferous bark be finely comminuted and mixed in a homogeneous dispersion with the paper pulp and cast together with the same. This is opposed merely to the sprinkling of back chips on a paper carrier or the aggregation of different materials with pulp. This homogeneous mixture presents a more even and substantially more significant filter material in which discrete particles of material, having a high degree of adsorption capability are dispersed over the entire filter. The wood bark of the present invention being unchanged in chemical or physical structure (i.e. not being pulped) creates a significantly different filter, that when the paper pulp itself is formed of the same of similar material. By merely adding the bark as particulate discrete matter, the suberin lattice is not broken and the quality of the bark is retained.

What is claimed is:

1. A cigarette filter comprising a porous element formed of cellulose pulp fibrous material in which between 5 to 40% by weight of finely comminuted dry and loose particles of bark of coniferous wood species are homogeneously dispersed, the particles having a diameter of between 1 $\mu$ and 40 $\mu$.

2. A cigarette filter as claimed in claim 1 wherein the cellulosic material is fibrous paper pulp.

3. A cigarette filter as claimed in claim 1 wherein the coniferous wood species is obtained from the pine tree.

4. A cigarette filter as claimed in claim 1 comprising 12.5% by weight of said coniferous wood species.

5. A smoking article having a filter at one end comprising a porous fibrous cellulose material in which between 5 and 40% by weight of finely comminuted pine bark dry discrete particles of between 1 $\mu$ and 40 $\mu$ size are homogeneously dispersed.

6. A method of forming a cigarette filter comprising the steps of grinding coniferous wood bark into finely comminuted particles having a diameter between 1 $\mu$ and 40 $\mu$, drying said particles, admixing between 5 and 40% by weight of said particles into a cellulose fibrous pulp mixture to form a homogeneous dispersion therein, and thereafter forming said homogeneous dispersion into a filter.

* * * * *